US008414425B2

(12) United States Patent
Kasashima et al.

(10) Patent No.: US 8,414,425 B2
(45) **Date of Patent: *Apr. 9, 2013**

(54) GOLF BALL

(75) Inventors: Atsuki Kasashima, Chichibu (JP); Atsushi Komatsu, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 663 days.

This patent is subject to a terminal disclaimer.

(21) Appl. No.: 12/607,458

(22) Filed: Oct. 28, 2009

(65) Prior Publication Data

US 2011/0098131 A1 Apr. 28, 2011

(51) Int. Cl.
*A63B 37/06* (2006.01)

(52) U.S. Cl.
USPC ..... 473/373

(58) Field of Classification Search ..... 473/373, 473/374
See application file for complete search history.

(56) References Cited

U.S. PATENT DOCUMENTS

| | | | | |
|---|---|---|---|---|
| 5,306,760 | A | 4/1994 | Sullivan | |
| 5,312,857 | A | 5/1994 | Sullivan | |
| 6,358,159 | B1 * | 3/2002 | Yamagishi et al. | 473/374 |
| 6,575,849 | B2 | 6/2003 | Hayashi et al. | |
| 6,592,471 | B1 | 7/2003 | Watanabe et al. | |
| 6,688,993 | B2 * | 2/2004 | Sajima | 473/378 |
| 6,875,132 | B2 * | 4/2005 | Hayashi et al. | 473/374 |
| 7,708,655 | B2 * | 5/2010 | Kasashima et al. | 473/373 |
| 2003/0083154 | A1 | 5/2003 | Yamagishi et al. | |

FOREIGN PATENT DOCUMENTS

| | | | |
|---|---|---|---|
| JP | 2001-079116 | A | 3/2001 |
| JP | 2003-000761 | A | 1/2003 |
| JP | 2003-126298 | A | 5/2003 |
| WO | 98/46671 | A1 | 10/1998 |

* cited by examiner

*Primary Examiner* — Raeann Gorden
(74) *Attorney, Agent, or Firm* — Sughrue Mion, PLLC

(57) ABSTRACT

The invention provides a golf ball having a core, at least one intermediate layer encasing the core, and a cover. The intermediate layer is formed primarily of a specific ionomer resin composition that has been highly neutralized, and the cover is formed primarily of an ionomer resin composition containing a specific amount of a granular inorganic filler. The golf ball has an excellent durability to repeated impact and a good flight performance.

12 Claims, 1 Drawing Sheet

GOLF BALL

BACKGROUND OF THE INVENTION

The present invention relates to a golf ball having an excellent durability to repeated impact and a good flight performance.

Most golf balls currently in use are manufactured by employing a process such as injection molding or compression molding to coat a material composed chiefly of urethane resin or ionomer resin around a solid core that is generally made primarily of a rubber such as a diene rubber.

The main features required of a golf ball include distance, controllability, durability and feel; balls having these qualities in the highest degree are always desired. At the same time, a succession of golf balls with three-piece and other multilayer constructions has emerged in recent years. By providing golf balls with a multilayer construction, it has become possible to combine many materials of differing properties, and apportioning ball features among the respective layers has created possibilities for diverse ball designs.

Generally, in cases where the distance traveled by a golf ball is regarded as important, the core or cover is formed so as to be rather hard, thereby increasing the resilience of the ball when struck. In such a case, the distance can be extended, but the ball tends to have a hard feel, making the sense of exhilaration that is sought when playing the ball difficult to achieve. To address this concern and improve the feel, it is necessary to form the ball so as to be somewhat soft. However, because the ball will then have a lower rebound and a greater spin receptivity on shots with a driver, an increase in the distance will be difficult to achieve. Also, in such soft (low-hardness) balls, it is common to use a cover that employs a rather soft, crack-resistant, ionomer resin, but this tends to result in a poor scuffing resistance. The above rebound and scuff resistance may be improved by using a hard material in the cover, although when the cover is formed to a degree of hardness at which the desired rebound and scuff resistance are attainable, the cover becomes incapable of following deformation of the ball on impact, giving rise to the early onset of cracking.

While it is possible to improve the rebound and reduce the spin rate by forming an intermediate layer of a highly neutralized ionomer resin composition in which the ionomer resin degree of neutralization has been increased through the addition of a basic inorganic metal compound, the resulting ball often has a poor durability.

Hence, there exists a desire to satisfy at the same time the conflicting demands of improved distance, durability and feel. In particular, there is a desire for the development of a soft golf ball having an excellent feel which achieves both a good flight performance and has an excellent durability to repeated impact.

Prior art related to the present invention includes the three-piece solid golf ball disclosed in JP-A 2001-79116, which has an outermost layer composed of various types of thermoplastic elastomers to which a granular inorganic filler has been added. In addition, JP-A 2003-761 discloses a golf ball in which an inorganic filler has been included within a cover material composed primarily of an ionomer resin, and JP-A 2003-126298 discloses a golf ball wherein an inorganic filler has been included in a high-hardness resin.

SUMMARY OF THE INVENTION

It is therefore an object of the present invention to provide a golf ball endowed with both a good flight performance and a high durability to repeated impact.

The inventors have conducted extensive investigations in order to achieve the above object. As a result, they have discovered that, in a golf ball having a core, at least one intermediate layer and a cover, by using as the cover material an ionomer resin to which has been added a specific amount of a granular inorganic filler, a good rebound is achieved and the durability to repeated impact (durability to cracking) is greatly improved. In addition, they have also found that, by combining the foregoing cover with an intermediate layer formed of a highly neutralized ionomer resin composition obtained through the addition of a basic inorganic metal compound to a conventional ionomer resin so as to increase the degree of neutralization, the spin rate on shots with a driver can be reduced and an even better flight performance achieved.

Accordingly, the invention provides the following golf balls.

[1] A golf ball comprising a core, at least one intermediate layer and a cover, wherein the intermediate layer is formed primarily of a resin mixture comprising:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer in a weight ratio between 100:0 and 50:50;

(c) about 15 to about 150 parts by weight of a fatty acid and/or fatty acid derivative having a molecular weight of 228 to 1500; and (d) about 0.1 to about 17 parts by weight of a basic inorganic metal compound capable of neutralizing un-neutralized acid groups in the base resin and component (c); and the cover is formed primarily of a mixture comprising 100 parts by weight of an ionomer resin and 5 to 35 parts by weight of a granular inorganic filler.

[2] The golf ball of [1], wherein the core has a deflection when compressed under a final load of 1,275 N (130 kgf) from an initial load of 98 N (10 kgf) of from 3.5 to 6.0 mm.

[3] The golf ball of [1], wherein the intermediate layer includes from 5 to 35 parts by weight of granular inorganic filler per 100 parts by weight of the resin component.

[4] The golf ball of [1], wherein the granular inorganic filler is titanium dioxide and/or barium sulfate.

[5] The golf ball of [1], wherein the ball has a plurality of dimples formed on a surface thereof, which dimples number in all from 250 to 392 and have a total volume from 400 to 750 $mm^3$.

BRIEF DESCRIPTION OF THE DIAGRAMS

DETAILED DESCRIPTION OF THE INVENTION

Figure 1:
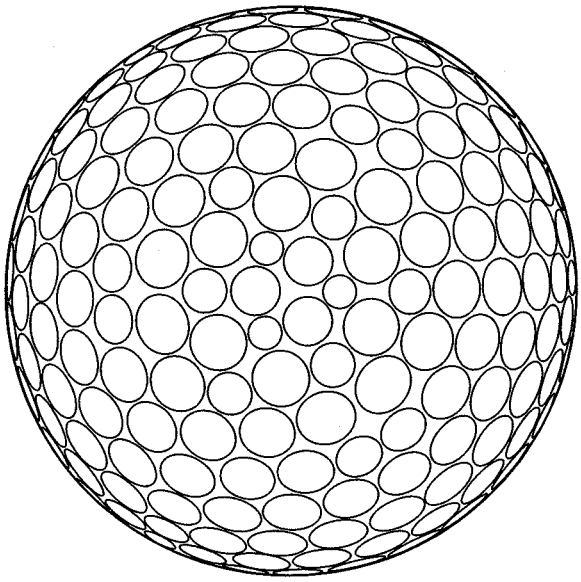
FIG. 1 is a top view of a golf ball showing an Arrangement (I) of dimples used in the examples of the invention and the comparative examples.

The invention is described more fully below.

The golf ball of the invention has a solid core, at least one intermediate layer, and a cover.

In the invention, the solid core may be formed using a known rubber composition. Although not subject to any particular limitation, suitable rubber compositions include those formulated as shown below.

A rubber core which has been molded and vulcanized from a rubber composition made up primarily of a commonly used rubber base material may be employed as the core in the present invention. Specifically, the core is formed using a molded and vulcanized rubber composition obtained by blending a base rubber with a crosslinking agent, a vulcanizing agent and, optionally, additives such as organosulfur compounds, antioxidants and fillers.

Polybutadiene is preferably used as the base rubber of the rubber composition that forms the core. It is preferable to use cis-1,4-polybutadiene having a cis structure of at least 40% as the polybutadiene. If desired, natural rubber, polyisoprene rubber, styrene-butadiene rubber or ethylene-propylene-diene rubber, for example, may be suitably included together with the polybutadiene in the base rubber.

An α,β-unsaturated carboxylic acid such as zinc methacrylate or zinc acrylate may be included as a co-crosslinking agent in the rubber composition. The use of zinc acrylate is especially preferred. It is preferable for the amount in which these unsaturated carboxylic acids are included per 100 parts by weight of the base rubber to be at least 10 parts by weight, and especially at least 15 parts by weight, but not more than 40 parts by weight, and especially not more than 35 parts by weight.

A vulcanizing agent is included in the above rubber composition. An organic peroxide is preferably used as the vulcanizing agent. The organic peroxide, which is exemplified by dicumyl peroxide, may be a single type used alone or may be a mixture of two or more types. The organic peroxide may be a commercially available product, illustrative examples of which include Perhexa 3M (produced by NOF Corporation), Percumyl D (NOF Corporation), and Luperco 231XL and Luperco 101XL (both produced by Atochem Co.). The amount of vulcanizing agent included per 100 parts by weight of the base rubber is preferably at least 0.1 part by weight, and more preferably at least 0.2 part by weight, but preferably not more than 2 parts by weight.

In the invention, an organosulfur compound may be included so as to further improve the core resilience. Specifically, it is recommended that thiophenols, thionaphthols, halogenated thiophenols or metal salts thereof be included. Illustrative examples include pentachlorothiophenol, pentafluorothiophenol, pentabromothiophenol, p-chlorothiophenol, the zinc salt of pentachlorothiophenol, and diphenylpolysulfides, dibenzylpolysulfides, dibenzoylpolysulfides, dibenzothiazoylpolysulfides and dithiobenzoylpolysulfides having from 2 to 4 sulfurs. The use of diphenyldisulfide or the zinc salt of pentachlorothiophenol is especially preferred.

The organosulfur compound is preferably included in an amount of at least 0.1 part by weight per 100 parts by weight of the above base rubber. If too much organosulfur compound is included, the hardness may become too low; on the other hand, if too little is included, a rebound improving effect cannot be expected.

In addition, an antioxidant may be included. Examples of commercial products include Nocrac NS-6, Nocrac NS-30 and Nocrac SP-N (Ouchi Shinko Chemical Industry Co., Ltd.), and Yoshinox 425 (Yoshitomi Pharmaceutical Industries, Ltd.). These may be used singly or as combinations of two or more thereof.

The filler is not subject to any particular limitation. For example, zinc oxide, barium sulfate and calcium carbonate may be suitably included.

The core-forming rubber composition which includes the above ingredients is prepared using a conventional mixer, such as a Banbury mixer or a roll mill. In cases where the core is molded using such a rubber composition, molding may be carried out by compression molding or injection molding using a given core-forming mold. The resulting molded body is then heated and cured under temperature conditions sufficient for the crosslinking agent and co-crosslinking agent included in the rubber composition to act, thereby giving a core having a specific hardness profile. The vulcanization conditions are not subject to any particular limitation. For example, when dicumyl peroxide is used as the crosslinking agent and zinc acrylate is used as the co-crosslinking agent, the conditions are generally set to about 100 to 200° C., and especially 150 to 180° C., for 10 to 40 minutes, and especially 12 to 20 minutes.

The diameter of the core obtained by the above manufacturing method is preferably at least 30 mm, more preferably at least 35 mm, and even more preferably at least 36 mm, but preferably not more than 40 mm, more preferably not more than 39 mm, and even more preferably not more than 38 mm.

In the present invention, the core has a deformation, when compressed under a final load of 1,275 N (130 kgf) from an initial load of 98 N (10 kgf), of at least 3.5 mm but not more than 6.0 mm. The lower limit of this value is preferably at least 4.0 mm, and more preferably at least 4.3 mm. The upper limit is preferably not more than 5.5 mm, and more preferably not more than 5.0 mm. If the core is softer than the above value (large deformation), the core resilience diminishes. Conversely, if the core is harder than the above value (small deformation), the feel of the ball may worsen.

It is recommended that the core have a specific gravity of at least 1.05, and preferably at least 1.1, but not more than 1.25, and preferably not more than 1.2.

The structure of the above core is not limited to one layer, and may be a multilayer structure of two or more layers. By giving the core a multilayer structure, it is possible to reduce the spin rate on shots with a driver, and it is possible to further increase the distance traveled by the ball. In addition, the spin properties and the feel of the ball at the time of impact can be further improved. In such cases, the core will have at least an inner core layer (center sphere) and an outer core layer.

The golf ball of the invention has at least one intermediate layer which encases the core, and a cover which encases the intermediate layer. The materials of the above intermediate layer and cover are described in detail below.

In the present invention, the intermediate layer is formed primarily of a resin composition which includes: 100 parts by weight of a resin component composed of, in admixture,

- a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and
- (e) a non-ionomeric thermoplastic elastomer in a weight ratio between 100:0 and 50:50;

(c) about 15 to about 150 parts by weight of a fatty acid and/or fatty acid derivative having a molecular weight of 228 to 1500; and (d) about 0.1 to about 17 parts by weight of a basic inorganic metal compound capable of neutralizing un-neutralized acid groups in the base resin and component (c).

Above components (a) to (e) are described below.

Component (a) and component (b) serve as the base resin of the resin composition which forms the intermediate layer. Component (a) is an olefin-unsaturated carboxylic acid random copolymer and/or a metal ion neutralization product of an olefin-unsaturated carboxylic acid random copolymer, and component (b) is an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer. In the present invention, either of above components (a) and (b) may be used singly or both may used in combination.

Here, the olefin in above component (a) and component (b) generally has at least two carbons but not more than 8 carbons, and most preferably not more than 6 carbons. Illustrative examples include ethylene, propylene, butene, pentene, hexene, heptene and octene. Ethylene is especially preferred.

Examples of the unsaturated carboxylic acid include acrylic acid, methacrylic acid, maleic acid and fumaric acid. Acrylic acid and methacrylic acid are especially preferred.

In addition, the unsaturated carboxylic acid ester included in above component (b) is preferably a lower alkyl ester of the above unsaturated carboxylic acid, illustrative examples of which include methyl methacrylate, ethyl methacrylate, propyl methacrylate, butyl methacrylate, methyl acrylate, ethyl acrylate, propyl acrylate and butyl acrylate. Butyl acrylate (n-butyl acrylate, i-butyl acrylate) is especially preferred.

The random copolymer of component (a) and component (b) may be obtained by the random copolymerization of the above components by a known method. Here, it is recommended that the content (acid content) of the unsaturated carboxylic acid included in the random copolymer be preferably at least 2 wt %, more preferably at least 6 wt %, and even more preferably at least 8 wt %, but preferably not more than 25 wt %, more preferably not more than 20 wt %, and even more preferably not more than 15 wt %. At a low acid content, the resilience may decrease, and at a high acid content, the processability may decrease.

The random copolymer neutralization products of components (a) and (b) may be obtained by neutralizing some of the acid groups in the above random copolymer with metal ions. Here, illustrative examples of metal ions which neutralize the acid groups include Na, $K^+$, $Li^+$, $Zn^{++}$, $Cu^{++}$, $Mg^{++}$, $Ca^{++}$, $Co^{++}$, $Ni^{++}$ and $Pb^{++}$. Of these, preferred use may be made of $Na^+$, $Li^+$, $Zn^{++}$ and $Mg^{++}$; $Mg^{++}$ and $Zn^{++}$ are especially recommended. The degree of neutralization of the random copolymer by these metal ions is not subject to any particular limitation. Such neutralization products may be obtained by a known method. For example, the above metal ions may be introduced into the above random copolymer by using compounds such as formates, acetates, nitrates, carbonates, bicarbonates, oxides, hydroxides or alkoxides thereof.

A commercial product may be used as above component (a). Illustrative examples include Nucrel 1560 (DuPont-Mitsui Polychemicals Co., Ltd.), Himilan 1554, Himilan 1557, Himilan 1601, Himilan 1605 and Himilan 1706 (all produced by DuPont-Mitsui Polychemicals Co., Ltd.), and Surlyn 7930 (E.I. DuPont de Nemours & Co.).

Likewise, a commercial product may be used as above component (b). Illustrative examples include Nucrel AN4213C, Nucrel AN4311, Nucrel AN4318 and Nucrel AN4319 (all produced by DuPont-Mitsui Polychemicals Co., Ltd.), Himilan 1855, Himilan 1856 and Himilan AM7316 (all produced by DuPont-Mitsui Polychemicals Co., Ltd.), and Surlyn 6320 and Surlyn 8120 (both produced by E.I. DuPont de Nemours & Co.). The use of a zinc-neutralized ionomer resin (e.g., Himilan AM7316) is especially preferred.

Above component (a) and component (b) may be used individually or both may be used in combination as the base resin of the above intermediate layer-forming resin composition. The mixing ratio of these two components, expressed by weight as component (a) to component (b), is from 100:0 to 0:100.

Component (c) is a fatty acid or fatty acid derivative having a molecular weight of at least 228. This component contributes to improving the flow properties of the resin composition; it has a very small molecular weight compared with the thermoplastic resin of above component (a), and thus contributes to a marked decrease in the melt viscosity of the mixture. Because the fatty acid (or fatty acid derivative) in the present invention has a molecular weight of 228 or more and contains a high content of acid groups (or derivative moieties thereof), its addition results in little loss in resilience.

The fatty acid or fatty acid derivative serving as component (c) may be an unsaturated fatty acid or fatty acid derivative having a double bond or triple bond in the alkyl moiety, or it may be a saturated fatty acid or fatty acid derivative in which all the bonds in the alkyl moiety are single bonds. The molecular weight is at least 228, preferably at least 256, more preferably at least 280, and even more preferably at least 300, but not more than 1,500, preferably not more than 1,000, more preferably not more than 600, and even more preferably not more than 500. If the molecular weight is too low, it will be impossible to achieve an improvement in the heat resistance, in addition to which the content of acid groups will be so high that interactions with acid groups present in the base resin may lower the flow-improving effects. On the other hand, if the molecular weight is too high, a distinct flow-improving effect may not appear.

Specific examples of the fatty acid serving as component (c) include stearic acid, 12-hydroxystearic acid, behenic acid, oleic acid, linoleic acid, linolenic acid, arachidic acid and lignoceric acid. Of these, preferred use may be made of stearic acid, arachidic acid, behenic acid and lignoceric acid.

The fatty acid derivative is exemplified by derivatives in which the proton on the acid group of the fatty acid has been substituted. Exemplary fatty acid derivatives of this type include metallic soaps in which the proton has been substituted with a metal ion. Metal ions that may be used in such metallic soaps include $Li^+$, $Ca^{++}$, $Mg^{++}$, $Zn^{++}$, $Mn^{++}$, $Al^{+++}$, $Ni^{++}$, $Fe^{++}$, $Fe^{+++}$, $Cu^{++}$, $Sn^{++}$, $Pb^{++}$ and $Co^{++}$. Of these, $Ca^{++}$, $Mg^{++}$ and $Zn^{++}$ are especially preferred.

Specific examples of fatty acid derivatives that may be used as component (c) include magnesium stearate, calcium stearate, zinc stearate, magnesium 12-hydroxystearate, calcium 12-hydroxystearate, zinc 12-hydroxystearate, magnesium arachidate, calcium arachidate, zinc arachidate, magnesium behenate, calcium behenate, zinc behenate, magnesium lignocerate, calcium lignocerate and zinc lignocerate. Of these, magnesium stearate, calcium stearate, zinc stearate, magnesium arachidate, calcium arachidate, zinc arachidate, magnesium behenate, calcium behenate, zinc behenate, magnesium lignocerate, calcium lignocerate and zinc lignocerate are preferred.

The amount of component (c) used per 100 parts by weight of the resin component containing above component (a) and/or component (b) (referred to below as the "base resin") and containing also the subsequently described component (e) is at least about 50 parts by weight, and preferably at least about 81 parts by weight, but not more than about 150 parts by weight, and preferably not more than about 120 parts by weight. If the amount of above component (c) is too low, the melt viscosity may decrease, resulting in a lower processability. On the other hand, if it is too high, the durability may decrease.

Use may also be made of known metallic soap-modified ionomers (see, for example, U.S. Pat. No. 5,312,857, U.S. Pat. No. 5,306,760 and International Disclosure WO 98/46671) when using above component (a) and/or component (b), and component (c).

The basic inorganic filler of component (d) is included to neutralize the acid groups in above component (a) and/or component (b), and in component (c). When above component (d) is not included, and in particular when a metal-modified ionomer resin alone (e.g., a metal soap-modified ionomer resin of the type mentioned in the foregoing patent publications, alone), is mixed under applied heat, as mentioned below, the metallic soap and unneutralized acid groups present on the ionomer undergo exchange reactions, generating a fatty acid. Because the fatty acid has a low thermal stability and readily vaporizes during molding, it causes molding defects. Moreover, if the fatty acid thus generated deposits on the surface of the molded material, it substantially lowers paint film adhesion.

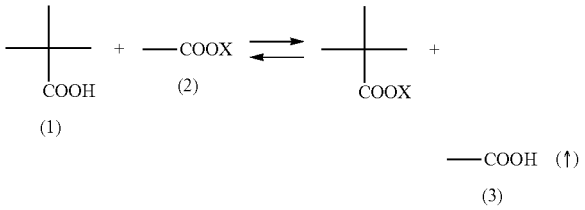

(1) unneutralized acid group present on the ionomer resin
(2) metallic soap
(3) fatty acid
X: metal atom To solve such problems, it is essential to include as component (d) a basic inorganic metal compound which neutralizes acid groups present in above component (a) and/or component (b), and in component (c). The inclusion of component (d) confers excellent properties. Namely, the acid groups in above component (a) and/or component (b) and in component (c) are neutralized, and synergistic effects from the inclusion of each of these components increase the thermal stability of the resin composition while at the same time imparting a good moldability, and also enhance the resilience as a golf ball-forming material.

It is recommended that above component (d) be a basic inorganic metal compound—preferably a monoxide—which is capable of neutralizing acid groups in above component (a) and/or component (b), and in component (c). Because such compounds have a high reactivity with the ionomeric resin and the reaction by-products contain no organic matter, the degree of neutralization of the resin composition can be increased without a loss of thermal stability.

The metal ions used here in the basic inorganic metal compound are exemplified by $Li^{+}$, $Na^{+}$, $K^{+}$, $Ca^{++}$, $Mg^{++}$, $Zn^{++}$, $Al^{+++}$, $Ni^{+}$, $Fe^{++}$, $Fe^{+++}$, $Cu^{++}$, $Mn^{++}$, $Sn^{++}$, $Pb^{++}$ and $Co^{++}$. Illustrative examples of the inorganic metal compound include basic inorganic fillers containing these metal ions, such as magnesium oxide, magnesium hydroxide, magnesium carbonate, zinc oxide, sodium hydroxide, sodium carbonate, calcium oxide, calcium hydroxide, lithium hydroxide and lithium carbonate. Of these, as noted above, a monoxide is preferred. The use of magnesium oxide, which has a high reactivity with ionomeric resins, is especially preferred in the present invention.

Component (d) is included in an amount, per 100 parts by weight of the above resin component, of at least about 0.1 part by weight, and preferably at least about 0.5 part by weight, but not more than about 17 parts by weight, and preferably not more than about 15 parts by weight. If the amount of above component (d) included is too low, improvements in thermal stability and resilience will not be observed. On the other hand, if the amount is too high, the thermal resistance of the composition may instead decline due to excessive basic inorganic metal compound.

The non-ionomeric thermoplastic elastomer serving as component (e) is optionally included to further improve the feel of the ball on impact and the rebound. Illustrative examples include thermoplastic elastomers such as thermoplastic polyester elastomers, thermoplastic block copolymers and thermoplastic urethanes. The above component (e) is included in an amount, expressed as a weight ratio of the above-described base resin to component (e), of from 100:0 to 50:50.

From the standpoint of processability, it is recommended that the intermediate layer-forming resin composition which includes above components (a) to (e) have a melt index (measured in accordance with JIS-K6760 at a test temperature of 190° C. and a test load of 21 N (2.16 kgf)) of at least 0.5 g/10 min, preferably at least 0.8 g/10 min, and more preferably at least 1.0 g/min, but not more than 20 g/10 min, and preferably not more than 15 g/10 min. If the melt index of the resin composition is too low, the processability may markedly decrease.

Although the specific gravity of the resin composition itself is not subject to any particular limitation, it is recommended to be preferably at least 0.9 and to have an upper limit of preferably not more than 1.3, more preferably not more than 1.2, and even more preferably not more than 1.15.

The above resin composition is obtained by mixing under applied heat the above-described component (a) and/or component (b), component (c), component (d) and component (e), and has an optimized melt index. It is recommended that at least 70 mol %, preferably at least 80 mol %, and more preferably at least 90 mol %, of the acid groups in the resin composition be neutralized. A high degree of neutralization more reliably suppresses the exchange reactions that pose a problem in the above-described cases where the base resin and the fatty acid (or fatty acid derivative) alone are used, thus making it possible to prevent the generation of fatty acids. As a result, a material can be obtained which has a markedly increased thermal stability, a good moldability, and a substantially higher resilience than conventional ionomer resins.

An inorganic granular filler may optionally be included in the above resin composition so as to further improve the durability. This inorganic granular filler may be a known inorganic granular filler and is not subject to any particular limitation, although the use of titanium dioxide and barium sulfate is preferred in the present invention. The amount per 100 parts by weight of the above resin component is preferably at least 5 parts by weight, and more preferably at least 9 parts by weight, but preferably not more than 30 parts by weight, and more preferably not more than 26 parts by weight.

Various additives may optionally be added to the resin composition containing above components (a) to (e). Additives which may be used include pigments, antioxidants, ultraviolet absorbers and light stabilizers.

The method used to form the intermediate layer may be a known method and is not subject to any particular limitation. For example, a method may be employed which involves placing a prefabricated core within a mold, then melting under applied heat or mixing and melting under applied heat, and subsequently injection-molding the above intermediate layer-forming resin composition.

The Shore D hardness of the intermediate layer is set to preferably at least 30, and more preferably at least 40, but preferably not more than 60, and more preferably not more than 56. At a Shore D hardness below 30, the rebound may decrease, whereas at more than 60, the ball may crack more easily, resulting in a poor durability.

The thickness of the intermediate layer is not subject to any particular limitation, although it is recommended that the intermediate layer be formed to a thickness of at least 0.8 mm, and especially 1.0 mm, but not more than 4.0 mm, and especially not more than 3.0 mm.

It is recommended that the intermediate layer have a specific gravity of at least 0.9, and especially at least 0.95, but not more than 1.3, and especially not more than 1.15. If the specific gravity is too large, it will be difficult to uniformly disperse a large amount of the subsequently described filler in the material, possibly resulting in a loss of the effects of the invention. On the other hand, if the specific gravity is too small, the desired rebound and durability may not be attainable.

The construction of the above intermediate layer is not limited to a single layer. If necessary, two or more intermediate layers having different properties may be formed within the above-described range. By forming a plurality of intermediate layers, the spin rate on shots with a driver can be reduced, enabling an even greater increase in distance to be achieved. Also, the spin properties and feel at the time of impact can be further improved.

The golf ball of the invention is arrived at by forming a cover over, and thereby encasing, the surface of the above intermediate layer. The cover is formed of a resin composition which is composed primarily of an ionomer resin and includes a specific amount of an inorganic granular filler. In the present invention, including this filler makes it is possible to achieve a good rebound and also to enhance the durability of the cover to repeated impact.

Preferred examples of the above ionomer resin include commercial products such as Surlyn 6320, Surlyn 8120 and Surlyn 7930 (E.I. DuPont de Nemours & Co.), and Himilan 1557, Himilan 1555, Himilan 1601, Himilan 1605, Himilan 1706 and Himilan 1855 (DuPont-Mitsui Polychemicals Co., Ltd.).

Here, the above cover material has a Shore D hardness, after including the inorganic granular filler, of preferably at least 40, and more preferably at least 50, but preferably not more than 70, and more preferably not more than 65. If the Shore D hardness is too low, the rebound may decrease and the spin rate may rise, possibly shortening the distance traveled by the ball. On the other hand, if the Shore D hardness is too high, the feel and controllability of the ball may worsen.

Titanium dioxide and barium sulfate may be suitably used as the granular inorganic filler included in the above cover material. The use of precipitated barium sulfate is especially preferred. Here, the particle size of the above granular inorganic filler is set to at least 0.1 μm, but not more than 10 μm. In this case, the particles are not limited to a shape that is truly spherical, so long as they have a diameter within the above-indicated range. Also, it is preferable to set the specific gravity of the above granular inorganic filler to at least 3.5, and especially at least 4.0, but not more than 5.5, and especially not more than 5.0.

The granular inorganic filler is included in an amount, per 100 parts by weight of the ionomer resin, of preferably at least 5 parts by weight, and more preferably at least 15 parts by weight, but preferably not more than 35 parts by weight, and more preferably not more than 25 parts by weight. If the amount of granular inorganic filler included is too small, the influence on durability, rebound and feel will be small, and sufficient effects may not be achieved. On the other hand, if the amount of granular inorganic filler included is too large, uniform dispersion will be difficult, which may cause a loss in durability and symmetry.

Various additives may be optionally included in the above cover material. For example, pigments, dispersants, antioxidants, ultraviolet absorbers and light stabilizers may be suitably included.

A known method may be used as the method of forming the cover and is not subject to any particular limitation. For example, a method wherein a prefabricated core with intermediate layer formed thereon is placed in a mold and the above cover material is melted under applied heat, or mixed and melted under applied heat, and subsequently injection-molded may be employed. Alternatively, use may be made of a method in which a pair of hemispherical half-cups are molded beforehand from the cover material, then the core is enclosed by these half-cups and molded under applied pressure at 120 to 170° C. for 1 to 5 minutes.

Particularly in cases where the cover material is injection-molded, to ensure a flowability that is particularly appropriate for injection molding and improve the moldability, it is desirable to adjust the melt flow rate. In such a case, it is recommended that the melt flow rate (MFR), as measured in accordance with JIS-K6760 at a test temperature of 190° C. and a test load of 21.18 N (2.16 kgf), be adjusted to preferably at least 1.0 g/10 min, more preferably at least 2.0 g/10 min, and even more preferably at least 3.0 g/10 min, but not more than 20 g/10 min, and preferably not more than 15 g/10 min. If the melt flow rate is too large or too small, the processability may markedly decrease.

The thickness of the cover thus formed is not subject to any particular limitation, and is preferably at least 0.8 mm, and more preferably at least 1 mm, but preferably not more than 2 mm, and more preferably not more than 1.5 mm. If the cover thickness is too large, the rebound may decrease. On the other hand, if the cover thickness is too small, the durability may decrease.

Although the specific gravity of the cover is not subject to any particular limitation, to achieve the specific objects of the invention and also to optimize the moment of inertia, it is desirable for the specific gravity to be set to at least 1.0, and especially at least 1.05, but not more than 1.3, and especially not more than 1.2.

The construction of the cover is not limited to one layer; if necessary, two or more layers may be formed of materials having different properties. In this case, it is recommended that the overall cover be adjusted to, for example, a thickness and a hardness within the above-indicated ranges.

In the golf ball of the present invention, because the above-described ball construction lowers the spin rate on impact, which tends to result in a lower trajectory, it is desirable to carry out dimple design in such a way as to enable a greater lift to be achieved. In addition, to enhance the fashionability and durability of the golf ball, the cover may be subjected to various treatments, such as surface preparation, stamping and painting.

Here, it is recommended that the number of dimple types, which refers to the number of dimple types of mutually differing diameter and/or depth, be preferably at least two types, and more preferably at least three types. It is recommended that the upper limit be not more than eight types, and in particular not more than six types.

It is recommended that the total number of dimples in this case be preferably at least 250, and more preferably at least 270, but not more than 392, and preferably not more than 370. If the total number of dimples is too low or too high, an optimal lift may not be achieved and the ball may travel a less than desirable distance.

Nor is any particular limitation imposed on the geometrical arrangement of the dimples; use may be made of a known arrangement, such as an octahedral or an icoshedral arrangement. At this time, from the standpoint of reducing variability in the flight of the ball, preferred use may be made of a dimple arrangement such that the surface of the ball has thereon not even a single great circle which intersects no dimples. The dimple shapes are not limited to circular shapes, and may also be suitably selected from among polygonal, teardrop, oval and other shapes. It is recommended that the dimple diameter (in polygonal shapes, the diagonal length) be at least 2 mm, and preferably at least 2.5 mm, but not more than 8 mm, and preferably not more than 7 mm.

It is recommended that the dimple surface coverage, from the standpoint of reducing air resistance, be at least 75%, and especially at least 79%. This surface coverage can be increased by raising the number of dimples formed, interspersing a plurality of dimples types of differing diameter, and using dimple shapes in which the distance between neighboring dimples (land width) becomes substantially 0.

The total volume of the dimples refers to the sum of the volumes of those portions circumscribed by dimple walls and the curved surfaces of land areas on the ball surface. This total volume is preferably set to from 400 to 750 $mm^3$, and especially from 450 to 700 $mm^3$.

The golf ball of the invention may be made to conform with the Rules of Golf for competitive play, and may be formed to a diameter of not less than 42.67 mm. It is generally suitable to set the weight to not less than 45.0 g, and preferably not less than 45.2 g, but not more than 45.93 g.

The golf ball of the present invention has the above-described core, intermediate layer and cover, and preferably has numerous dimples on the cover surface. The overall ball has a deflection, when compressed under a final load of 1,275 N (130 kgf) from an initial load state of 98 N (10 kgf), of preferably at least 3 mm, and more preferably at least 3.3 mm, but preferably not more than 5 mm, and more preferably not more than 4.5 mm. If the deflection is too small, the feel on impact may worsen and, on long shots such as with a driver in which the ball incurs a large deformation, may subject the ball to an excessive rise in the spin rate, shortening the distance traveled by the ball. On the other hand, if the deflection is too large, the ball may have a dead feel and a less than adequate rebound, shortening the distance traveled, in addition to which the ball may have a poor durability to cracking on repeated impact.

The present invention provides a golf ball having a core, at least one intermediate layer and a cover, wherein the intermediate layer is formed of a specific ionomer resin composition that includes above components (a) to (e) and is highly neutralized, and the cover is formed of an ionomer resin composition containing a specific amount of a granular inorganic filler, thereby endowing the ball with both an excellent durability to repeated impact and a good flight performance. The present invention may be applied to any golf ball having a core, an intermediate layer and a cover, although it exhibits particularly outstanding effects when applied to golf balls which use a core having a deflection, when compressed under a final load of 1,275 N (130 kgf) from an initial load state of 98 N (10 kgf), of from 3.5 to 6.0 mm. That is, the inventive golf ball, along with exhibiting a good rebound at the time of impact, does not readily crack because the cover follows the deformation of the core well even when the core undergoes a large deformation.

EXAMPLES

The following Examples and Comparative Examples are provided by way of illustration and not by way of limitation.

Examples 1 to 3

Comparative Example 1

Formation of Core

Solid cores were fabricated by preparing the rubber compositions shown in Table 1 below, then molding and vulcanizing at 155° C. for 15 minutes. The numbers shown in the table under "Formulation" indicate parts by weight.

TABLE 1

| | Formulation | | |
|---|---|---|---|
| | No. 1 | No. 2 | No. 3 |
| cis-1,4-Polybutadiene | 100 | 100 | 100 |
| 1,1-Bis(tert-butylperoxy)cyclohexane | 0.6 | 0.6 | 0.6 |
| Dicumyl peroxide | 0.6 | 0.6 | 0.6 |
| 2,2'-Methylenebis(4-methyl-6-t-butylphenol) | 0.1 | 0.1 | 0.1 |
| Zinc diacrylate | 19.81 | 19.81 | 19.81 |
| Zinc oxide | 5 | 5 | 5 |
| Barium sulfate | 16.72 | 22.25 | 27.9 |
| Zinc salt of pentachlorothiophenol | 0.1 | 0.1 | 0.1 |
| Zinc stearate | 5 | 5 | 5 |

Details on the materials in Table 1 are given below.

Polybutadiene: Available under the trade name "BR 730" from JSR Corporation.

1,1-Bis(tert-butylperoxy)cyclohexane: Available from NOF Corporation.

Dicumyl peroxide: Available under the trade name "Percumyl D" from NOF Corporation.

2,2'-Methylenebis(4-methyl-6-t-butylphenol): Available under the trade name "Nocrac NS-6" from Ouchi Shinko Chemical Industry Co., Ltd.

Zinc diacrylate: Available from Nihon Jyoryu Kogyo Co., Ltd.

Zinc oxide: Available from Sakai Chemical Industry Co., Ltd.

Barium sulfate: Available under the trade name "Precipitated Barium Sulfate #100" from Sakai Chemical Industry Co., Ltd.

Zinc salt of pentachlorothiophenol: Available from Tokyo Kasei Kogyo Co., Ltd.

Zinc stearate: Available under the trade name "Zinc Stearate G" from NOF Corporation.

Formation of Intermediate Layer and Cover

Figure 2:
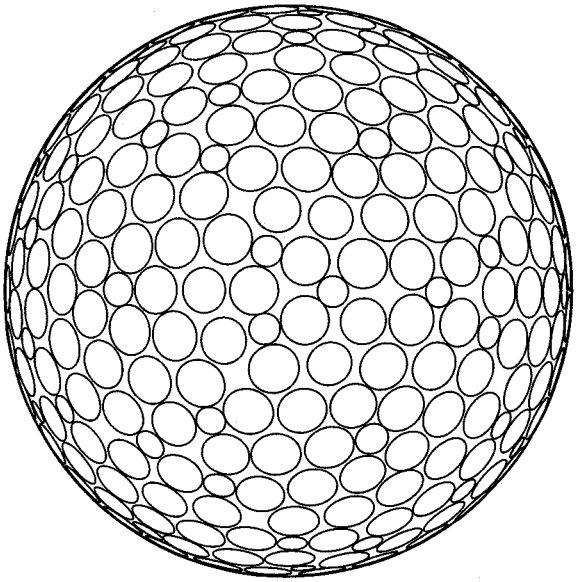
FIG. 2 is a top view of a golf ball showing an Arrangement (II) of dimples used in the examples of the invention.

Next, an intermediate layer of the formulation shown in Table 2 and a cover of the formulation shown in Table 3 were successively injection-molded around the core obtained as described above, thereby producing three-piece solid golf balls having an intermediate layer and a cover over the core. At this time, the dimples shown in FIG. 1 (Dimples I) or FIG. 2 (Dimples II) were formed on the cover surface. Details of the dimples in FIGS. 1 and 2 are shown in Table 4. The numbers shown in the table under "Formulation" indicate parts by weight.

TABLE 2

| | Formulation C | Formulation D |
|---|---|---|
| Nucrel AN4319 | 100 | 100 |
| Magnesium stearate | 100 | 100 |
| Magnesium oxide | 2.8 | 2.8 |
| Precipitated barium sulfate | | 20 |

Details on the materials in Table 2 are given below.

Nucrel AN4319: A terpolymer available from DuPont-Mitsui Polychemicals Co., Ltd.

Precipitated barium sulfate:

Available under the trade name "Precipitated Barium Sulfate #100" from Sakai Chemical Industry Co., Ltd.

TABLE 3

| | | Formulation A | Formulation B |
|---|---|---|---|
| Ionomer resin | Himilan 1557 | 50.00 | 51.60 |
| | Himilan 1555 | 50.00 | |
| | Himilan 1601 | | 48.40 |
| Precipitated barium sulfate | | 20.00 | |
| Polyethylene wax | | 1.00 | 1.00 |
| Magnesium stearate | | 1.00 | 0.639 |
| Titanium dioxide | | 2.80 | 2.54 |

Details on the materials in Table 3 are given below.

Himilan: An ionomeric resin available from DuPont-Mitsui Polychemicals Co., Ltd.

Precipitated barium sulfate:

Available under the trade name "Precipitated Barium Sulfate #100" from Sakai Chemical Industry Co., Ltd.

Polyethylene wax: Available under the trade name "Sanwax 161P" from Sanyo Chemical Industries, Ltd.

Titanium dioxide: Available under the trade name "Tipaque R550" from Ishihara Sangyo Kaisha, Ltd.

TABLE 4

| No. | Number | Diameter (mm) | Depth (mm) | $V_0$ | Total volume ($mm^3$) | SR | VR |
|---|---|---|---|---|---|---|---|
| 1 | 12 | 4.60 | 0.15 | 0.47 | 568 | 0.81 | 0.784 |
| 2 | 234 | 4.40 | 0.15 | 0.47 | | | |
| 3 | 60 | 3.80 | 0.14 | 0.47 | | | |
| 4 | 12 | 3.50 | 0.13 | 0.47 | | | |
| 5 | 12 | 2.50 | 0.10 | 0.47 | | | |
| Total | 330 | | | | | | |

TABLE 5

| No. | Number | Diameter (mm) | Depth (mm) | $V_0$ | Total volume ($mm^3$) | SR | VR |
|---|---|---|---|---|---|---|---|
| 1 | 288 | 3.90 | 0.15 | 0.47 | 508 | 0.80 | 0.773 |
| 2 | 60 | 3.80 | 0.15 | 0.47 | | | |
| 3 | 12 | 2.90 | 0.13 | 0.47 | | | |

TABLE 5-continued

| No. | Number | Diameter (mm) | Depth (mm) | $V_0$ | Total volume ($mm^3$) | SR | VR |
|---|---|---|---|---|---|---|---|
| 4 | 60 | 2.40 | 0.10 | 0.47 | | | |
| 5 | 12 | 3.40 | 0.14 | 0.47 | | | |
| Total | 330 | | | | | | |

Dimple Definitions

Diameter: Diameter of flat plane circumscribed by edge of dimple.

Depth: Maximum depth of dimple from flat plane circumscribed by edge of dimple.

$V_0$: Spatial volume of dimple below flat plane circumscribed by dimple edge, divided by volume of cylinder whose base is the flat plane and whose height is the maximum depth of dimple from the base.

Dimple volume:

Sum of volume of portions circumscribed by dimple walls and curved surfaces of land areas on ball surface.

SR: Sum of individual dimple surface areas, each defined by the surface area of the flat plane circumscribed by the edge of a dimple, as a percentage of surface area of ball sphere were it to have no dimples thereon.

VR: Sum of volumes of individual dimples formed below flat plane circumscribed by the edge of the dimple, as a percentage of volume of ball sphere were it to have no dimples thereon.

For the golf balls obtained as described above in Examples 1 to 3 and Comparative Example 1, various properties, including the thickness, hardness and deflection of the respective layers, and the flight performance and durability to repeated impact were rated according to the following criteria. The results are shown in Table 6.

Rating the Ball Properties

Deflection (mm) of Core and Finished Ball

The core and the finished ball were placed on a hard plate, and the deflection when compressed under a final load of 1,275 N (130 kgf) from an initial load state of 98 N (10 kgf) was measured.

Cover Hardness

The Shore D hardness of the cover layer alone, as measured in accordance with ASTM D-2240.

Flight Performance

The distance traveled by the ball when hit at a head speed of 45 m/s with a W#1 mounted on a golf swing robot was measured. A ViQ Driver (2008 model; loft, 10.5°) manufactured by Bridgestone Sports Co., Ltd. was used as the club. The spin rate was the value obtained by using an apparatus for measuring initial conditions to measure the ball immediately after impact.

Durability to Repeated Impact

The durability of the golf ball was evaluated using an ADC Ball COR Durability Tester produced by Automated Design Corporation (U.S.). The ball was fired using air pressure and made to consecutively strike two metal plates arranged in parallel. The durability was rated using the average number of shots required for the ball to crack. Here, average values were obtained by furnishing four balls of the same type for testing, repeatedly firing each of the four balls until it cracked, and averaging the number of shots required for the respective balls to crack. The type of tester used was a horizontal COR durability tester, and the incident velocity of the balls on the metal plates was set to 43 m/s.

TABLE 6

| | | Example | | | Comparative Example |
|---|---|---|---|---|---|
| | | 1 | 2 | 3 | 1 |
| Core | Type | No. 1 | No. 2 | No. 1 | No. 3 |
| | Diameter (mm) | 37.3 | 37.3 | 37.3 | 37.3 |
| | Deflection (mm) | 4.6 | 4.6 | 4.6 | 4.6 |
| | Specific gravity | 1.177 | 1.146 | 1.177 | 1.211 |
| Intermediate layer | Type | C | D | C | C |
| | Thickness (mm) | 1.35 | 1.35 | 1.35 | 1.35 |
| | Center hardness (Shore D) | 50 | 50 | 50 | 50 |
| | Specific gravity | 0.95 | 1.09 | 0.95 | 0.95 |
| Cover | Material | A | A | A | B |
| | Thickness (mm) | 1.35 | 1.35 | 1.35 | 1.35 |
| | Surface hardness (Shore D) | 61 | 61 | 61 | 60 |
| | Specific gravity | 1.1 | 1.1 | 1.1 | 0.97 |
| Ball | Outermost diameter (mm) | 42.70 | 42.70 | 42.70 | 42.70 |
| | Deflection (mm) | 3.7 | 3.7 | 3.7 | 3.7 |
| | Dimples | I | I | II | I |
| Flight performance | W#1 spin (rpm) | 2500 | 2500 | 2500 | 2550 |
| | W#1 distance (m) | 230 | 230 | 226 | 228 |
| | Durability | 126 | 153 | 131 | 90 |

It is apparent from the results in Table 6 that the golf balls in Examples 1 to 3, which were within the scope of the invention, each had a better durability to repeated impact than the golf ball in Comparative Example 1, which was outside the scope of the invention.

The invention claimed is:

1. A golf ball comprising a core, at least one intermediate layer and a cover, wherein the intermediate layer is formed primarily of a resin mixture comprising:

100 parts by weight of a resin component composed of, in admixture, a base resin of (a) an olefin-unsaturated carboxylic acid random copolymer and/or a metal ion neutralization product of an olefin-unsaturated carboxylic acid random copolymer mixed with (b) an olefin-unsaturated carboxylic acid-unsaturated carboxylic acid ester random terpolymer and/or a metal ion neutralization product of an olefin-unsaturated carboxylic acid-unsaturated carboxylic acid ester random terpolymer in a weight ratio between 100:0 and 0:100, and (e) a non-ionomeric thermoplastic elastomer wherein the weight ratio of the base resin to component (e) is between 100:0 and 50:50;

(c) 81 to 150 parts by weight of a fatty acid and/or fatty acid derivative having a molecular weight of 228 to 1500; and (d) about 0.1 to about 17 parts by weight of a basic inorganic metal compound capable of neutralizing un-neutralized acid groups in the base resin and component (c); and the cover is formed primarily of a mixture comprising 100 parts by weight of an ionomer resin and 5 to 35 parts by weight of a granular inorganic filler.

2. The golf ball of claim 1, wherein the core has a deflection when compressed under a final load of 1,275 N (130 kgf) from an initial load of 98 N (10 kgf) of from 3.5 to 6.0 mm.

3. The golf ball of claim 1, wherein the intermediate layer includes from 5 to 35 parts by weight of granular inorganic filler per 100 parts by weight of the resin component.

4. The golf ball of claim 1, wherein the granular inorganic filler is titanium dioxide and/or barium sulfate.

5. The golf ball of claim 1, wherein the ball has a plurality of dimples formed on a surface thereof, which dimples number in all from 250 to 392 and have a total volume from 400 to 750 $mm^3$.

6. The golf ball of claim 1, wherein the intermediate layer has a specific gravity of from 0.9 to 1.3.

7. The golf ball of claim 1, wherein the intermediate layer-forming resin composition has a melt index of from 0.5 to 15 g/10 min.

8. The golf ball of claim 1, wherein the intermediate layer-forming resin composition is a resin composition in which at least 90 mol % of the acid groups is neutralized.

9. The golf ball of claim 1, wherein the cover has a specific gravity of from 1.0 to 1.3.

10. The golf ball of claim 1, wherein the cover material has a melt flow rate (MFR) of from 1.0 to 20 g/10 min.

11. The golf ball of claim 1, wherein the granular inorganic filler has a particle size of from 0.1 to 10 μm.

12. The golf ball of claim 1, wherein the golf ball has a deflection, when compressed under a final load of 1,275 N (130 kgf) from an initial load state of 98 N (10 kgf), of from 3 to 5 mm.

* * * * *